US005398941A

United States Patent [19]

Paulson

[11] Patent Number: 5,398,941

[45] Date of Patent: Mar. 21, 1995

[54] METHOD FOR CONDUCTING RACING EVENTS

[76] Inventor: Rodney L. Paulson, 900 Farnam St. #408, Omaha, Nebr. 68102

[21] Appl. No.: 194,031

[22] Filed: Feb. 9, 1994

[51] Int. Cl.[6] ..... A63F 3/00

[52] U.S. Cl. ..... 273/445; 273/86 B; 273/86 R; 273/246; 482/14; 482/19; 340/323 R

[58] Field of Search ..... 273/86 B, 86 R, 246, 273/445, 434; 482/14, 19; 340/323 R

[56] References Cited

U.S. PATENT DOCUMENTS

| | | | |
|---|---|---|---|
| 3,690,666 | 9/1972 | Seitz | 273/246 |
| 3,795,907 | 3/1974 | Edwards | 340/323 R |
| 4,264,076 | 4/1981 | Duncan | 273/246 |
| 5,048,841 | 9/1991 | Manney et al. | 273/246 |
| 5,186,460 | 2/1993 | Fongeallaz et al. | 273/86 B |

*Primary Examiner*—Vincent Millin
*Assistant Examiner*—Kerry Owens
*Attorney, Agent, or Firm*—Zarley, McKee, Thomte, Voorhees & Sease

[57] ABSTRACT

A method for conducting racing events begins with the determination of the number of lanes to be utilized in all of the individual races of the overall competition. Each racing competition includes a plurality of individual sprint races preferably equal in number to the predetermined number of lanes being utilized. Each competitor for the entire racing competition is assigned a predetermined speed ranking, and then the competitors are aligned for the individual sprint races. The competitor with the highest speed ranking is aligned in the first lane of the first sprint, and subsequent competitors in order of descending speed ranking are aligned in the first lane of subsequent sprints until the first lane of each individual sprint is filled. The remaining competitors are then aligned in the second lane of each sprint, again in descending speed ranking order. Any subsequent lanes are aligned in the same fashion. Each of the individual sprint races are then conducted with the first competitor in each sprint designated a sprint winner. The time of each sprint winner is recorded in each individual sprint, and compared with the times of the other sprint winners to determine the competition winner.

6 Claims, No Drawings

METHOD FOR CONDUCTING RACING EVENTS

TECHNICAL FIELD

The present invention relates generally to racing events, such as horse racing, motorcycle racing, etc., and more particularly to an improved method for conducting races so as to improve the interests and excitement of individual and final races.

BACKGROUND OF THE INVENTION

In conventional racing events, it is a standard procedure to initially perform a qualifying event, wherein a selected number of the fastest competitors qualify to proceed to a final race. In events such as foot races, the competitors with the fastest times are typically given the inside lane of the track. In automobile racing, the vehicles with the fastest times are arranged in the front line of the pack of cars.

While conventional methods for conducting races may serve to demonstrate the fastest competitor, they are not always the most exciting races to view. In addition, the conventional method for conducting races discourages large fields of competitors, since entry fees are typically required for such races, and only the continuously fastest competitors would benefit from the races.

SUMMARY OF THE INVENTION

It is therefore an object of the present invention to provide an improved method for arranging and conducting races to increase spectator excitement.

Another object of the present invention is to provide a method for arranging and conducting races which increases the chances of winning for competitors which may not have the fastest qualifying times.

These and other objects of the present invention will be apparent to those skilled in the art.

The method for conducting racing events of the present invention begins with the determination of the number of lanes to be utilized in all of the individual races of the overall competition. Each racing competition includes a plurality of individual sprint races preferably equal in number to the predetermined number of lanes being utilized. Each competitor for the entire racing competition is assigned a predetermined speed ranking, and then the competitors are aligned for the individual sprint races. The competitor with the highest speed ranking is aligned in the first lane of the first sprint, and subsequent competitors in order of descending speed ranking are aligned in the first lane of subsequent sprints until the first lane of each individual sprint is filled. The remaining competitors are then aligned in the second lane of each sprint, again in descending speed ranking order. Any subsequent lanes are aligned in the same fashion. Each of the individual sprint races are then conducted with the first competitor in each sprint designated a sprint winner. The time of each sprint winner is recorded in each individual sprint, and compared with the times of the other sprint winners to determine the competition winner.

DESCRIPTION OF THE PREFERRED EMBODIMENT

The method of arranging and conducting a racing competition of the present invention follows a specific race configuration, a specific alignment of racing competitors, and a specific method of determining the winners of races. The main objective of the method is to stage a series of races to qualify, advance and eliminate a group of racing competitors into one final championship race.

The overall method of the present invention will be identified throughout this specification as a sprint tier race, which consists of several individual sprints.

Each sprint tier race includes four key elements, namely: (1) race configuration, (2) speed rankings, (3) tier alignments, and (4) determining winners.

Race configuration refers to the process of setting the number of individual sprints, the number of lanes, and the number of entries in an overall sprint tier race. A sprint tier race has a minimum of one qualifying event, two lanes, and two individual sprints.

Speed rankings are the numerical ranking of entries according to the recorded time of a competitor in a qualifying race. The competitor who has the fastest recorded time from the qualifying race has a speed ranking of (1). Speed rankings then proceed in descending order according to the recorded times of the competitors in the qualifying race.

While it is preferable to have an individual qualifying race at the time of the sprint tier race, it is envisioned that speed rankings may also be established by averaging past recorded times of competitors from other sprint tier races.

Tier alignments are the specific alignment of all competitors within individual sprints of a sprint tier race. The tier alignments provide a unique distribution of racing competitors, and utilize the speed rankings of the competitors to complete the specific sprint assignment and/or the specific lane assignment of each racing competitor.

TABLE I

| | Two Lanes 4 Competitors | |
|---|---|---|
| | L-1 | L-2 |
| Sprint 1 | 1 | 3 |
| Sprint 2 | 2 | 4 |

The tier alignment utilizes a table utilizing the number of lanes specified in the horizontal direction, and the number of sprints to be run oriented along a vertical access. Table 1 sets up a matrix which shows the tier alignment for a two-lane competition with four competitors comprising two separate individual sprints. As discussed above, the speed rankings are determined in a qualifying race for the four competitors, the fastest competitor given the ranking of 1 and the slowest competitor given the ranking of 4. The tier alignment begins in the upper left corner of the matrix, with speed ranking 1 assigned to lane 1 of sprint 1. The alignment of entries then continues downwardly to sprint 2, lane 1, utilizing the descending order of speed rankings until the assignment for lane 1 in all of the sprints are completed. The alignment of entries then continues with lane 2 sprint 1, and continues downwardly until all of the sprints in lane 2 are completed, proceeding in descending order of the speed rankings.

TABLE 2

| | Two Lanes 8 Competitors | |
|---|---|---|
| | L-1 | L-2 |
| Sprint 1 | 1 | 5 |
| Sprint 2 | 2 | 6 |

TABLE 2-continued

| | Two Lanes 8 Competitors | |
|---|---|---|
| | L-1 | L-2 |
| Sprint 3 | 3 | 7 |
| Sprint 4 | 4 | 8 |

Table 2 shows a matrix utilizing a two-lane sprint tier race and including eight competitors. Since only two lanes are being utilized, the eight competitors must be aligned in four separate sprints. Utilizing the same alignment procedure, the competitor with speed ranking 1 is aligned in lane 1 of sprint 1, the competitor with speed ranking 2 is aligned in lane 1 of sprint 2., continuing downward in lane 1 until sprints 1–4 are completed. Lane 2 then holds speed rankings 5–8 in sprints 1–4 respectively.

TABLE 3

| | Three Lanes 9 Competitors | | |
|---|---|---|---|
| | L-1 | L-2 | L-3 |
| Sprint 1 | 1 | 4 | 7 |
| Sprint 2 | 2 | 5 | 8 |
| Sprint 3 | 3 | 6 | 9 |

TABLE 4

| | Four Lanes 8 Competitors | | | |
|---|---|---|---|---|
| | L-1 | L-2 | L-3 | L-4 |
| Sprint 1 | 1 | 3 | 5 | 7 |
| Sprint 2 | 2 | 4 | 6 | 8 |

TABLE 5

| | Four Lanes 16 Competitors | | | |
|---|---|---|---|---|
| | L-1 | L-2 | L-3 | L-4 |
| Sprint 1 | 1 | 5 | 9 | 13 |
| Sprint 2 | 2 | 6 | 10 | 14 |
| Sprint 3 | 3 | 7 | 11 | 15 |
| Sprint 4 | 4 | 8 | 12 | 16 |

Tables 3, 4 and 5 show the alignment of entries for 3 and 4 lane races utilizing various numbers of competitors. It should be noted that the number of competitors must be a multiple of the number of lanes to be utilized under the method of the present invention, so that a complete matrix table may be formulated for each sprint tier race.

The final element of the method is determining the winners of individual sprints. The winner of an individual sprint in a sprint tier race is determined by the competitor who crosses the finish line first in that individual sprint. Such a winner is designated a sprint winner. A sprint tier winner, in a sprint tier race is determined by the fastest recorded time of the sprint winners. Thus, the method of determining winners of a sprint tier race does not allow sprint winners to have an additional race among the sprint winners to determine the sprint tier winner. Rather, the sprint tier winner, in a sprint tier race, is determined solely by the fastest time recorded of the sprint winners during their individual sprints. This method encourages all racing competitors to give their best performance to have a chance to win their sprint as well as win the overall sprint tier race. Although the individual competitors are divided into several individual sprints, they are still competing with everyone in the sprint tier race to be the sprint tier winner.

TABLE 6

| | L-1 | L-2 | L-3 | L-4 | Winners |
|---|---|---|---|---|---|
| Sprint 1 | 1 | 5 | 9 | 13 | W1 |
| Sprint 2 | 2 | 6 | 10 | 14 | W2 |
| Sprint 3 | 3 | 7 | 11 | 15 | W3 |
| Sprint 4 | 4 | 8 | 12 | 16 | W4 |

As shown in Table 6, the preferred sprint tier race utilizes a four lane track with four individual sprints. The method of determining winners would render four sprint winners W1–W4 and a single sprint tier winner. The sprint tier winner is the sprint winner W1–W4 with the fastest recorded time.

An additional element of excitement and competition is added to a sprint tier race, in view of the fact that the method of determining winners does not insure that each sprint winner will have the fastest recorded times in a sprint tier race. The sprint tier winner will be the competitor with the fastest recorded time in the entire sprint tier race, but the recorded times of the other sprint winners may not necessarily be the second, third and fourth fastest in the entire sprint tier race. For example, if the second fastest recorded time in a sprint tier race was in a sprint with the sprint tier winner, the second fastest recorded time would not be recognized because that competitor did not win the individual sprint. Each competitor must win their individual sprint in a sprint tier race to be recognized as a sprint winner, and then to have a chance to be the sprint tier winner.

Sprint tier racing, according to the method of the present invention may be organized and staged with two basic formats: (1) a series of single sprint tier races without an advancement and elimination process, or (2) a series of sprint tier races to qualify, advance and eliminate a group of competitors, with one final championship race. A series of sprint tier races, as set forth in tables 1–5, would provide a series of sprint winners and sprint tier winners for an overall event. However, when a series of sprint tier races is utilized as an intermediate step to qualify for a championship race, the series of sprint tier races is designated as a sprint tier elimination configuration, wherein competitors are eliminated to provide a qualifying field for the championship race. The championship race will then determine the championship sprint winners and a championship sprint tier winner. Each elimination race utilizes the configuration of a sprint tier race described above. The championship race would utilize the same configuration as the elimination races, utilizing the sprint winners of a plurality of elimination races.

A championship race is considered the last race of a sprint tier elimination configuration. The championship race will be the only race that follows the elimination races. The sprint tier winner of the championship race in a sprint tier elimination configuration is considered the champion. The sprint winners of the championship race in a sprint tier elimination configuration are given ranking designations that coincide with the number of sprint winners in the championship race. Thus, if there were four sprint winners in the championship race, each sprint winner would receive a top four award. An example of a sprint tier elimination configuration with a championship race is as follows. In this example, the minimum requirements of a two-lane track are utilized, which therefore requires two elimination races and one championship race. The total number of competitors qualifying for the elimination configuration would be eight, with four competitors in elimination race 1 and four competitors in elimination race 2. The competitors in each elimination race would be qualified for their races by a separate qualification race or other event, as described hereinabove. Thus, in this example, two qualification races would be utilized to provide the eight competitors for the sprint tier elimination configuration.

TABLE 7

| | Elimination Race 1 | | |
|---|---|---|---|
| | L-1 | L-2 | Winners |
| Sprint 1 | 1 | 3 | W1 |
| Sprint 2 | 2 | 4 | W2 |

As shown in Table 7, elimination race 1 utilizes a four competitor matrix with speed rankings 1 and 2 in lane 1 of sprints 1 and 2, and speed rankings 3 and 4 in lane 2 of sprints 1 and 2. The winners of sprints 1 and 2 are designated as W1 and W2 and would have recorded times.

TABLE 8

| | Elimination Race 2 | | |
|---|---|---|---|
| | L-1 | L-2 | Winners |
| Sprint 1 | 1 | 3 | W3 |
| Sprint 2 | 2 | 4 | W4 |

Elimination race 2 is set up in the same way as elimination race 1 and would produce two additional sprint tier winners W3 and W4 with recorded times.

TABLE 9

| | Championship Race | | |
|---|---|---|---|
| | L-1 | L-2 | Winners |
| Sprint 1 | 1 | 3 | WC1 |
| Sprint 2 | 2 | 4 | WC2 |

The championship race is set up in the same way as elimination races 1 and 2, giving winners W1–W4 speed rankings according to their recorded times in winning the individual sprints of the two elimination races. The speed rankings again would place the fastest speed ranking, 1 in lane 1 of sprint 1 speed ranking 2 in lane 1 of sprint 2, with speed rankings 3 and 4 in lane 2 of sprints 1 and 2, respectively. The two individual sprints of the championship race will produce two winners, WC1 and WC2. The winner with the fastest speed would be declared champion of the entire sprint tier elimination configuration. Since there are two sprint winners in the championship race, each of these two sprint winners would also receive a top two award.

A second example of a sprint tier elimination competition, utilizing a four-lane track would require four elimination races of four sprints each and a final championship race of four individual sprints.

TABLE 10

| | L-1 | L-2 | L-3 | L-4 | Winners |
|---|---|---|---|---|---|
| | | Elimination Race 1 | | | |
| Sprint 1 | 1 | 5 | 9 | 13 | W1 |
| Sprint 2 | 2 | 6 | 10 | 14 | W2 |
| Sprint 3 | 3 | 7 | 11 | 15 | W3 |
| Sprint 4 | 4 | 8 | 12 | 16 | W4 |
| | | Elimination Race 2 | | | |
| Sprint 1 | 1 | 5 | 9 | 13 | W5 |
| Sprint 2 | 2 | 6 | 10 | 14 | W6 |

TABLE 10-continued

| | L-1 | L-2 | L-3 | L-4 | Winners |
|---|---|---|---|---|---|
| Sprint 3 | 3 | 7 | 11 | 15 | W7 |
| Sprint 4 | 4 | 8 | 12 | 16 | W8 |
| | | Elimination Race 3 | | | |
| Sprint 1 | 1 | 5 | 9 | 13 | W9 |
| Sprint 2 | 2 | 6 | 10 | 14 | W10 |
| Sprint 3 | 3 | 7 | 11 | 15 | W11 |
| Sprint 4 | 4 | 8 | 12 | 16 | W12 |
| | | Elimination Race 4 | | | |
| Sprint 1 | 1 | 5 | 9 | 13 | W13 |
| Sprint 2 | 2 | 6 | 10 | 14 | W14 |
| Sprint 3 | 3 | 7 | 11 | 15 | W15 |
| Sprint 4 | 4 | 8 | 12 | 16 | W16 |

Table 10 shows the four elimination races which are run to produce winners W1–W16. Four qualification races would be required to produce the 16 competitors utilized in each of the four elimination races. Each qualifying race would thereby give the 16 competitors a speed ranking of 1–16 for alignment in the particular elimination race. Thus, 64 competitors are utilized in the actual sprint tier elimination competition, although the number of participants may be much greater during the qualification races.

TABLE 11

| | Championship Race | | | | |
|---|---|---|---|---|---|
| | L-1 | L-2 | L-3 | L-4 | Winners |
| Sprint 1 | 1 | 5 | 9 | 13 | WC1 |
| Sprint 2 | 2 | 6 | 10 | 14 | WC2 |
| Sprint 3 | 3 | 7 | 11 | 15 | WC3 |
| Sprint 4 | 4 | 8 | 12 | 16 | WC4 |

Table 11 shows the alignment for the championship race based upon the four elimination races. Under the method of this invention, the recorded times of winners W1–W16 are utilized to assign new speed rankings 1–16. In the same manner as the alignment for the elimination races, the competitors are aligned with speed ranking 1 in lane 1 sprint 1, with the remaining competitors aligned in descending speed ranking first in lane 1, thence lane 2, thence lane 3 and finally lane 4. Since there are four sprint winners in the championship race, WC1–WC4, each sprint winner would receive a top four award. In addition, the individual winner WC1–WC4 with the fastest recorded time would be declared the champion of the sprint tier elimination competition.

Whereas the invention has been shown and described in connection with thee preferred embodiment thereof, it will be understood that many modifications, substitutions and additions may be made which are within the intended broad scope of the appended claims. There has therefore been shown and described an improved method for arranging and conducting a race which accomplishes at least all of the above stated objects.

I claim:

1. A method of conducting a racing competition among a plurality of competitors on a race track with a plurality of lanes, comprising the steps of:

determining the specific number "N" of lanes to be used in all races of the competition, N being greater than 1;

aligning competitors for a plurality of individual sprint races in predetermined lanes of predetermined individual sprints using predetermined speed rankings 1 through $N^2$ for each competitor;

aligning the competitor with a speed ranking of 1 in a first lane in a first sprint;

continuing the alignment of subsequent competitors in descending speed ranking order in the first lane of subsequent sprints until the first lane of each of N sprints are designated with the first N competitors;

aligning competitors with speed rankings N+1 through 2N in the second lane of sprint races 1−N in descending speed ranking order, respectively;

continuing with the alignment of subsequent lanes through lane N, using a descending order of speed rankings until the competitor with speed ranking $N^2$ is aligned in lane N, in the Nth sprint;

conducting each individual sprint race;

designating the first competitor to cross a finish line in each sprint as a sprint winner;

recording the time of each sprint winner;

comparing the times of all sprint winners after N sprints; and designating the sprint winner with the fastest recorded time as the competition winner.

2. The method of claim 1, further comprising the step of determining the competitors for subsequent sprint races, subsequent to the step of determining the number of lanes and prior to the step of aligning the competitors, said step of determining competitors comprising the steps of:

conducting a qualifying race having at least $N^2$ participants; and designating the first $N^2$ participants to finish the qualifying race as competitors for subsequent sprint races.

3. The method of claim 2, further comprising the step of determining speed rankings of the competitors by recording each designated competitors time in the qualifying race; comparing the recorded times; and designating each competitor with a speed ranking from $1-N^2$, descending from the fastest time to the slowest time.

4. A method of conducting a sprint tier race among sixteen competitors on a race track with four individual lanes, comprising the steps of:

aligning the competitors for first, second, third and fourth individual sprints in first, second, third and fourth lanes of each sprint, using predetermined speed rankings of 1–16 for each competitor;

aligning the competitor with a speed ranking of 1 in the first lane of the first sprint;

aligning the competitors with speed rankings of 2, 3 and 4 in the first lanes of the second, third and fourth sprints, respectively;

aligning the competitors with speed rankings of 5, 6, 7 and 8 in lane 2 of the first through fourth sprints, respectively;

aligning the competitors with speed rankings of 9, 10, 11 and 12 in lane 3 and the competitors with speed rankings of 13, 14, 15 and 16 in lane 4 of the first through fourth sprints respectively;

conducting each of said first through fourth sprints and designating the first competitor to cross a finish line in each sprint as a sprint winner.

5. The method of conducting a sprint tier race of claim 4, further comprising the steps of:

recording the times of the four sprint winners;

comparing the four recorded times; and designating the sprint winner with the fastest recorded time as the sprint tier winner.

6. The method of claim 4, further comprising:

conducting a second sprint tier race among a second set of sixteen competitors in fifth, sixth, seventh and eighth individual sprints;

designating the first competitor to cross a finish line in said fifth, sixth, seventh and eighth sprints as sprint winners;

conducting a third sprint tier race among a third set of sixteen competitors in ninth, tenth, eleventh and twelfth individual sprints;

designating the first competitor to cross a finish line in said ninth through twelfth sprints as sprint winners;

conducting a fourth sprint tier race among a fourth set of sixteen competitors in thirteenth, fourteenth, fifteenth and sixteenth individual sprints;

designating the first competitor to cross a finish line in said thirteenth through sixteenth sprints as sprint winners;

recording the time of each sprint winner of each of said sixteen individual sprints;

comparing the recorded times of said sprint winners and designating the competitor with the fastest recorded time as having a speed ranking of 1;

designating each remaining sprint winner with speed rankings of 2–16 in descending order according to descending order of fastest recorded times from the individual sprints;

aligning said 16 sprint winners for first, second, third and fourth individual championship sprints using said designated speed rankings resulting from the four sprint tier races;

aligning the competitors with speed rankings of 1, 2, 3 and 4 in the first lane of the first through fourth individual championship sprints, respectively;

aligning the competitors with speed rankings of 5, 6, 7 and 8 in lane 2, the competitors with speed rankings of 9, 10, 11 and 12 in lane 3 and the competitors with speed rankings of 13, 14, 15 and 16 in lane 4, of the first through fourth individual championship sprints, respectively;

conducting each of said first through fourth individual championship sprints and designating the first competitor to cross a finish line in each individual championship sprint as a championship sprint winner.

* * * * *